US006223398B1

(12) United States Patent
Leifeld

(10) Patent No.: US 6,223,398 B1
(45) Date of Patent: May 1, 2001

(54) WEB HEATING DEVICE FOR A FIBER PROCESSING MACHINE

(75) Inventor: Ferdinand Leifeld, Kempen (DE)

(73) Assignee: Trutzschler GmbH & Co., KG, Mönchengladbach (DE)

( * ) Notice: Subject to any disclaimer, the term of this patent is extended or adjusted under 35 U.S.C. 154(b) by 0 days.

(21) Appl. No.: 09/276,915

(22) Filed: Mar. 26, 1999

(30) Foreign Application Priority Data

Mar. 26, 1998 (DE) ..... 198 13 341

(51) Int. Cl.[7] ..... D01G 15/00

(52) U.S. Cl. ..... 19/98; 19/112; 19/161.1; 19/299

(58) Field of Search ..... 19/66 CC, 98, 19/99, 100, 101, 105, 106 R, 112, 161.1, 296, 299; 26/18.6, 78, 106; 28/77, 104

(56) References Cited

U.S. PATENT DOCUMENTS

| | | | | |
|---|---|---|---|---|
| 2,310,581 | | 2/1943 | Garrett, Sr. . | |
| 2,997,748 | * | 8/1961 | Ingram | 19/98 |
| 3,218,676 | * | 11/1965 | Lenk, Jr. | 19/105 |
| 3,283,366 | * | 11/1966 | Kalwaites | 19/106 R |
| 3,370,326 | * | 2/1968 | Law | 19/106 R |
| 3,824,650 | | 7/1974 | Watanabe . | |
| 3,928,696 | * | 12/1975 | Wandel et al. | 28/77 |
| 4,299,011 | * | 11/1981 | Rothen et al. | 19/106 R |
| 4,352,223 | * | 10/1982 | Felix et al. | 19/106 R |
| 4,858,276 | | 8/1989 | Frosch et al. . | |
| 4,888,856 | * | 12/1989 | Yescheskel et al. | 19/66 CC |
| 5,114,787 | * | 5/1992 | Chaplin et al. | 28/104 |
| 5,153,968 | * | 10/1992 | Sterin et al. | 19/66 CC |
| 5,406,679 | * | 4/1995 | Leifeld et al. | 19/106 R |
| 5,504,975 | * | 4/1996 | Bar et al. | 19/66 CC |
| 5,522,119 | * | 6/1996 | Leifeld et al. | 19/106 R |
| 5,617,618 | | 4/1997 | Fleissner . | |
| 5,855,043 | * | 1/1999 | Leifeld | 19/98 |

FOREIGN PATENT DOCUMENTS

| | | |
|---|---|---|
| 1 086 120 | 7/1960 | (DE) . |
| 23 64 262 | 6/1975 | (DE) . |
| 26 00 596 | 7/1976 | (DE) . |
| 32 48 048 | 4/1984 | (DE) . |
| 36 17 862 | 12/1987 | (DE) . |
| 89 05 100 | 8/1989 | (DE) . |
| 195 35 876 | 4/1997 | (DE) . |
| 0 799 922 | 10/1997 | (EP) . |
| 0 837 163 | 4/1998 | (EP) . |
| 2 699 043 | 5/1992 | (FR) . |
| 2 732 042 | 9/1996 | (FR) . |
| 841391 | 7/1960 | (GB) . |
| 2 090 300 | 7/1982 | (GB) . |
| 2 195 365 | 4/1988 | (GB) . |
| 55-71822 | 5/1980 | (JP) . |
| 62-125019 | 6/1987 | (JP) . |
| 62-125020 | 6/1987 | (JP) . |

OTHER PUBLICATIONS

Dübel, "Die Wakoflex–Walze, ein neues Walzenkonzept", textil praxis international, Jun. 1988, vol. 6,pp. 654–656.

Prömpler et al, "Thermobonding Kalander", avr–Allegemeiner Vliesstoff–Report 1, 1992, pp. 22, 24.

* cited by examiner

*Primary Examiner*—John J. Calvert
*Assistant Examiner*—Gary L. Welch
(74) *Attorney, Agent, or Firm*—Venable; Gabor J. Kelemen

(57) ABSTRACT

A textile fiber processing machine includes a device for forming a fiber web from a fiber lap; a device for advancing the fiber web to a web outputting device for discharging the web thereby in a direction of advance; and two cooperating calender rolls defining a nip receiving the web discharged by the web outputting device. The calender rolls are situated immediately adjacent the web outputting device downstream thereof as viewed in the direction of web advance. Further, a heating arrangement is provided for heating at least one of the calender rolls for thermo-bonding the web as it passes through the nip of the calender rolls.

12 Claims, 2 Drawing Sheets

WEB HEATING DEVICE FOR A FIBER PROCESSING MACHINE

CROSS REFERENCE TO RELATED APPLICATION

This application claims the priority of German Application No. 198 13 341.3 filed Mar. 26, 1998, which is incorporated herein by reference.

BACKGROUND OF THE INVENTION

This invention relates to a heating device for a fiber processing machine such as a carding machine or a roller card unit which produces a fiber web. At the output of the fiber processing machine calender rolls are provided for mechanically compressing (densifying) the web and further, a device is provided for binding the fibers to one another by heat.

The production of webs by roller card units or carding machines has always been of significant commercial importance which grew even further, particularly with the frequent use of natural fibers which require the roller card technology in case of thin webs. For strengthening the web, particularly in case of thin webs, a mixture of binding fibers with other chemical fibers or natural fibers has been processed, followed by a subsequent processing step in which the web, produced by the roller card, has been strengthened, for example, in a calender with heated rolls. The high degree of flexibility of the roller card process is a significant operational advantage. To increase the output of the machines it is a desideratum, on the one hand, to increase the operating width of the machines and, on the other hand, the output speed of the web. Since in case of width increase the costs for the machine and the feeder increase disproportionately to the widening, the latter has to be maintained within certain limits for economical reasons. Consequently, the development has been strongly concentrating on the increase of the output speed. Such increase, however, can occur in case of given web thicknesses only by increasing the web discharge delivery speeds. For this purpose, significant untapped possibilities may be found in the preparatory machines, roller card feeders and the roller cards themselves. Thus, a roller card is capable of producing fast-running thin webs and transferring them at high delivery speeds to the doffer. A drawback of this arrangement involves the subsequent guidance of the rapidly travelling webs downstream of the roller card to a successive processing machine, such as a thermobonding calender. To overcome these difficulties, the use of various additional devices has been suggested. According to one proposal, perforated belts have been provided which are placed under vacuum and advance the webs to the subsequent processing machine to ensure that the friction between the rapidly moved web and the surrounding air does not cause disturbances in the web. In such a solution, an exact coordination between the speed and strength of the vacuum in case of different web qualities and weights has been found to involve substantial difficulties. More particular and partially insurmountable difficulties, however, are encountered at the transfer locations between the delivery rolls of the roller card, the perforated belt and the feeding device in the calender, especially in case of high delivery speeds of 300 m/min and higher. These difficulties set technological limits which render significantly more difficult the starting, the normal operation and the stoppage which eventually lead to the result that only certain speeds can be set because above such speeds continuous disturbances are encountered. Lower output speeds, however, are uneconomical.

According to a known device, as disclosed in German Offenlegungsschrift (application published without examination) 36 17 862, a roller card unit is provided from which the web is introduced by means of conveying devices into a cross laying device and therefrom the web is further conveyed by additional advancing devices to a thermocalender in which the thermostrengthening is effected. The calender rolls have a low circumferential speed corresponding to the low delivery speed of the web. The transfers and directional changes of the web require a low speed to ensure that the web is not destroyed. It is a disadvantage of this arrangement that the production output is lowered.

SUMMARY OF THE INVENTION

It is an object of the invention to provide an improved device of the above-outlined type from which the discussed disadvantages are eliminated and which, while preserving a superior degree of flexibility and quality, permits a high operating speed and a high output rate.

This object and others to become apparent as the specification progresses, are accomplished by the invention, according to which, briefly stated, the textile fiber processing machine includes a device for forming a fiber web from a fiber lap; a device for advancing the fiber web to a web outputting device for discharging the web thereby in a direction of advance; and two cooperating calender rolls defining a nip receiving the web discharged by the web outputting device. The calender rolls are situated immediately adjacent the web outputting device downstream thereof as viewed in the direction of web advance. Further, a heating arrangement is provided for heating at least one of the calender rolls for thermo-bonding the web as it passes through the nip of the calender rolls.

A significant increase of the delivery speed is achieved by virtue of the fact that the thermobonding rolls are arranged in the immediate vicinity of the web output in the roller card unit so that the web runs by itself into the nip of the thermobonding roll pair. The web, after it leaves the thermobonding rolls, is strengthened such that it may have high transporting speeds or winding speeds without damaging or destroying the web. The measures according to the invention provide in a simple manner an early strengthening of the web so that it may be further processed while maintaining high working speeds. This results in a high output and, because of the significantly reduced disturbing effects and danger of tear, it also results in a higher quality of the product.

The invention has the following additional advantageous features:

- A preheating device provides that the web runs preheated into the nip of the calender rolls.
- The temperature of at least one of the calender rolls and/or the preheating device is adjustable.
- A cooling roll is arranged downstream of the heatable calender roll.
- The bending of the calender rolls is controlled.
- Floating rolls are used as calender rolls.
- The web loops around the calender rolls to provide for a greater heat transfer region of the roll surface.
- A web guide element is provided underneath one of the rolls of the web delivering device.
- At least one of the calender rolls is loaded, for example, by a spring, a weight or by a pneumatic or hydraulic device.
- The web delivering device is a withdrawing device such as a stripping roll.

DESCRIPTION OF THE PREFERRED EMBODIMENTS

Figure 1:
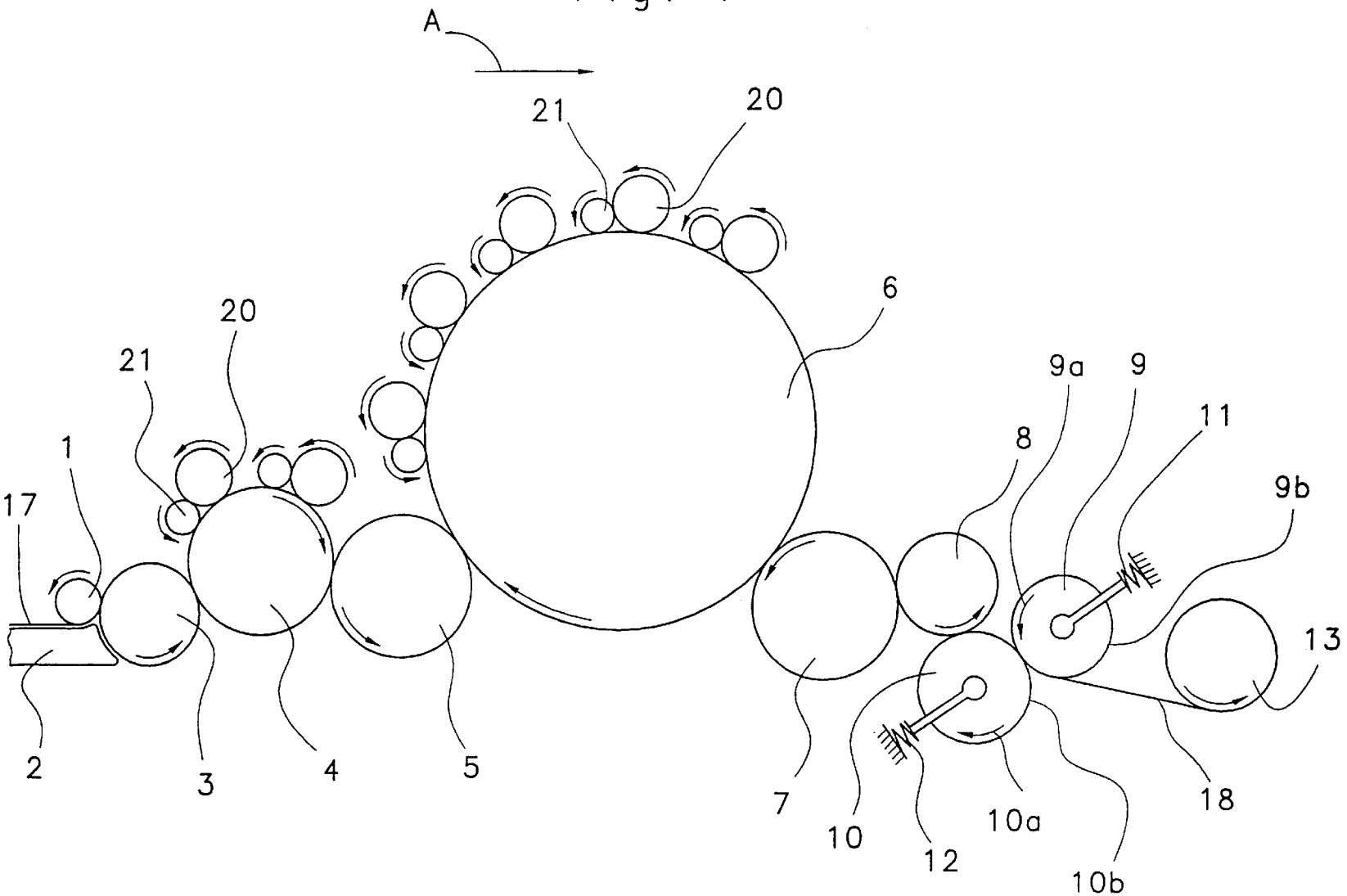
FIG. 1 is a schematic side elevational view of a roller card unit incorporating the invention.

FIG. 1 illustrates a roller card unit which has a fiber lap feeding device formed of a feed roll 1 and a feed table 2 cooperating therewith, an advance roll 3, a licker-in 4, a transfer roll 5, a main cylinder 6, a doffer 7 and a stripping roll 8. Two roll pairs cooperate with the licker-in 4 and five roll pairs cooperate with the carding cylinder 6. Each roll pair is formed of a working roll 20 and an inverter roll 21. Two cooperating heatable calender rolls 9, 10 are arranged downstream of the stripping roll 8, in the immediate vicinity thereof. The calender rolls 9 and 10 are biased, for example, by compression springs 11, 12 so that the smooth cylindrical surfaces 9*b*, 10*b* are pressed against one another. Downstream of the calender rolls 9, 10 (as viewed in the direction of material advance), a cooling roll 13 is arranged at a distance of, for example, a few centimeters therefrom. The directions of rotation of the rolls are indicated by curved arrows drawn thereinto. The fiber lap introduced into the lap-feeding device is designated at 17, whereas 18 designates the fiber web outputted by the roller card. The arrow A indicates the direction of run of the textile fiber material through the roller card unit whereas the directional arrows 7*a*, 8*a*, 9*a* and 10*a* indicate the rotary direction of the doffer 7, the stripping roll 8 and the calender rolls 9 and 10, respectively.

Figure 2:
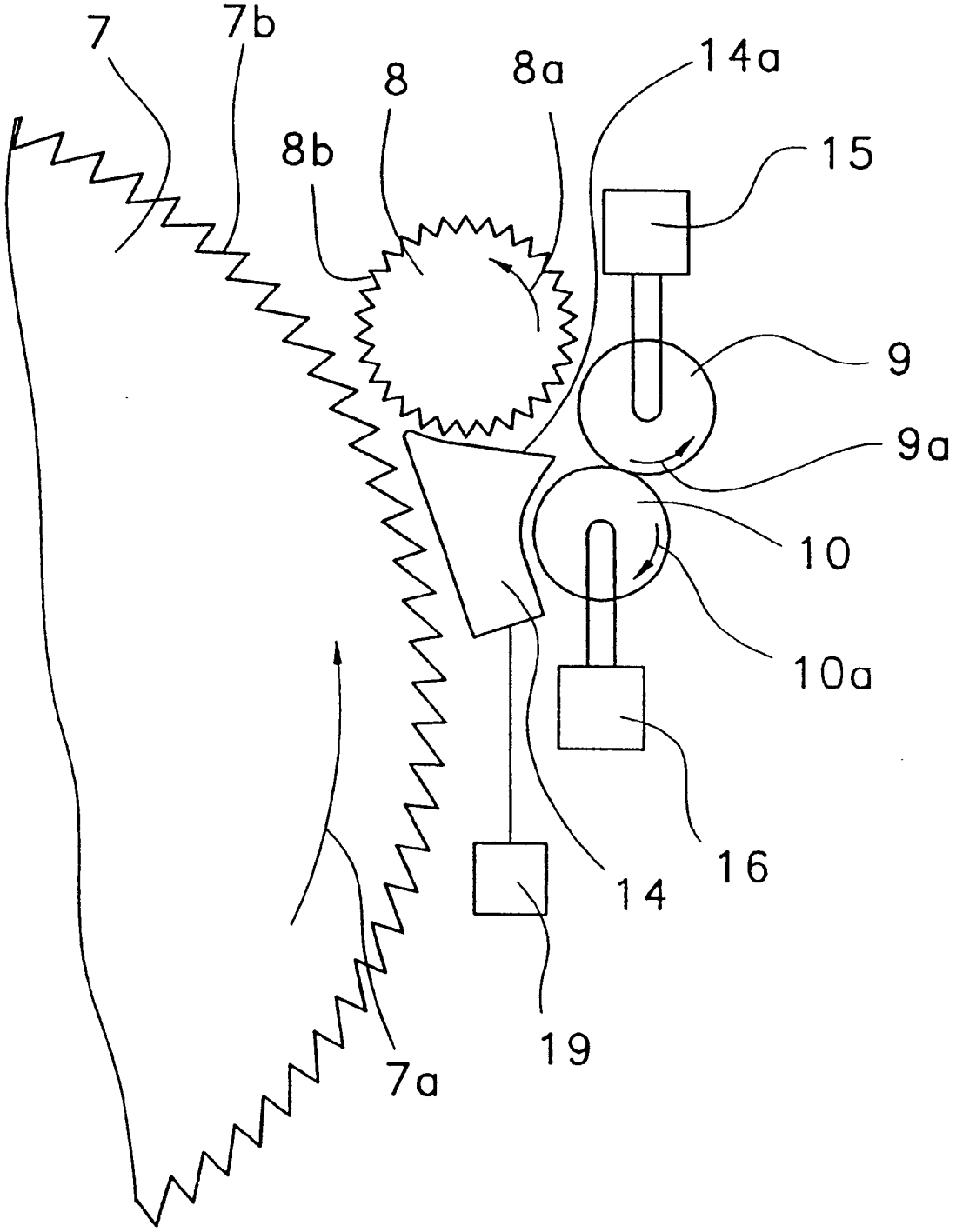
FIG. 2 is a schematic side elevational view on an enlarged scale of a web guide element positioned underneath a stripping roll and immediately upstream of calender rolls.

Turning to FIG. 2, the non-illustrated, coherent fiber web is taken off the doffer 7 by the stripping roll 8 as the clothing 8*b* of the stripping roll 8 cooperates with the clothing 7*b* of the doffer 7. Underneath the stripping roll 8 a supporting and guiding body 14 (web guiding element) is arranged which essentially has a triangular cross-sectional configuration. The upper face 14*a* of the web guiding element 14 is slightly concave. The radius of curvature of the face 14*a* is greater than the radius of the stripping roll 8. The frontal terminal zone of the web guiding element 14 has a sharp edge while the trailing terminal zone is rounded. The sharp edge at the frontal end of the web guiding element 14 prevents a deposition of impurities, such as honeydew. The face 14*a* is cleaned, for example, of trash by the web gliding thereon. The cross-sectional shape of the web guiding element 14 is adapted to the air flow conditions in the region between the doffer 7 and the stripping roll 8 as well between the calender rolls 9, 10. The face 14*a* of the web guiding element 14 is oriented towards the clothing 8*b* of the stripping roll 8, while the upstream end zone of the web guiding element 14 is oriented towards the nip defined between the doffer 7 and the stripping roll 8. The downstream end zone of the web guiding element 14 is situated in the region between the stripping roll 8 and the calender rolls 9, 10; the sharp terminal edge of the face 14*a* is oriented toward the nip defined by the calender rolls 9, 10. The web guiding element 14 is an extruded component, made, for example, of aluminum; it has an inner hollow space through which a stationary guide bar passes. The upstream and downstream end zones of the web guiding element 14 are situated on opposite sides with respect to a vertical diametral plane which contains the rotary axis of the stripping roll 8. The web guiding element 14 is heated in a controlled manner by means of a heating device 19 so that the web 18 enters in a preheated state the nip between the heated calender rolls 9, 10. The calender rolls 9 and 10 are each coupled to an individually temperature-controlled heating device 15 and 16, respectively. It is to be noted that a common heating device for both calender rolls 9 and 10 may be provided. The web is strengthened by the calender rolls 9, 10 by means of pressing and heating effect.

It will be understood that the above description of the present invention is susceptible to various modifications, changes and adaptations, and the same are intended to be comprehended within the meaning and range of equivalents of the appended claims.

What is claimed is:

1. A roller card unit comprising (a) first means for forming a fiber web from a fiber lap;

(b) second means for advancing the fiber web from said first means to a web outputting device for discharging the web thereby in a direction of advance;

(c) a web pressing device defining a nip receiving the web discharged by said web outputting device; said web pressing device being situated immediately adjacent said web outputting device downstream thereof as viewed in said direction of advance;

(d) heating means disposed in a zone of said web pressing device for heating said web for thermo-bonding said web as it passes through said nip; and (e) a cooling roll disposed downstream of said web pressing device and contacting said web.

2. The roller card unit as defined in claim 1, further comprising preheating means for heating said web upstream of said web pressing device.

3. The roller card unit as defined in claim 2, further comprising means for setting the temperature of said preheating means.

4. A roller card unit comprising (a) first means for forming a fiber web from a fiber lap;

(b) second means for advancing the fiber web from said first means to a web outputting device for discharging the web thereby in a direction of advance;

(c) a web pressing device comprising first and second cooperating rolls defining a nip receiving the web discharged by said web outputting device; said web pressing device being situated immediately adjacent said web outputting device downstream thereof as viewed in said direction of advance;

(d) heating means disposed in a zone of said web pressing device for heating said web for thermo-bonding said web as it passes through said nip; and (e) means for causing said web to contact said second calender roll along a circumferential length portion thereof after passing through said nip.

5. The roller card unit as defined in claim 4, further comprising means for setting the temperature of at least one of said calender rolls.

6. The roller card unit as defined in claim 4, further compromising means for floatingly supporting said calender rolls.

7. The roller card unit as defined in claim 4, further compromising means for pressing said calender rolls toward one another.

8. The roller card unit as defined in claim 4, wherein said heating means compromise means for heating at least one of said calender rolls.

9. A roller card unit comprising (a) first means for forming a fiber web from a fiber lap;

(b) second means for advancing the fiber web from said first means to a web outputting device for discharging the web thereby in a direction of advance; said web outputting device comprising a web-engaging roll;

(c) a web pressing device defining a nip receiving the web discharged by said web outputting device; said web pressing device being situated immediately adjacent said web outputting device downstream thereof as viewed in said direction of advance;

(d) heating means disposed in a zone of said web pressing device for heating said web for thermo-bonding said web as it passes through said nip; and (e) a stationary web guiding device situated underneath said web-engaging roll for guiding said web into said nip.

10. The roller card unit as defined in claim 9, further comprising means for heating said web guiding device, whereby said web runs into said nip in a preheated state.

11. A roller card unit comprising (a) first means for forming a fiber web from a fiber lap;

(b) second means for advancing the fiber web from said first means to a web outputting device for discharging the web thereby in a direction of advance; said web outputting device comprising a stripping roll (c) a web pressing device defining a nip receiving the web discharged by said web outputting device; said web pressing device being situated immediately adjacent said web outputting device downstream thereof as viewed in said direction of advance; and (d) heating means disposed in a zone of said web pressing device for heating said web for thermo-bonding said web as it passes through said nip.

12. A roller card unit comprising (a) first means for forming a fiber web from a fiber lap;

(b) second means for advancing the fiber web from said first means to a web outputting device for discharging the web thereby in a direction of advance;

(c) a web pressing device comprising first and second cooperating calender rolls defining a nip receiving the web discharge by said web outputting device; said web pressing device being situated immediately adjacent said web outputting device downstream thereof as viewed in said direction of advance;

(d) heating means disposed in a zone of said web pressing device for heating said web for thermo-bonding said web as it passes through said nip; and (e) means for causing said web to contact said first calender roll along a circumferential length portion thereof before passing through said nip.

* * * * *